US010854409B2

(12) United States Patent
Murakoshi et al.

(10) Patent No.: US 10,854,409 B2
(45) Date of Patent: Dec. 1, 2020

(54) ELECTROMAGNETIC RELAY

(71) Applicant: FUJITSU COMPONENT LIMITED, Tokyo (JP)

(72) Inventors: Takuji Murakoshi, Tokyo (JP); Kazuo Kubono, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 100 days.

(21) Appl. No.: 16/010,701

(22) Filed: Jun. 18, 2018

(65) Prior Publication Data

US 2019/0006139 A1 Jan. 3, 2019

(30) Foreign Application Priority Data

Jun. 28, 2017 (JP) ..... 2017-126249

(51) Int. Cl.

| | |
|---|---|
| ***H01H 1/54*** | (2006.01) |
| ***H01H 50/42*** | (2006.01) |
| ***H01H 50/64*** | (2006.01) |
| ***H01H 50/54*** | (2006.01) |
| ***H01H 50/28*** | (2006.01) |
| ***H01H 51/22*** | (2006.01) |
| *H01H 50/04* | (2006.01) |
| *H01H 50/56* | (2006.01) |
| *H01H 50/36* | (2006.01) |

(52) U.S. Cl.

CPC ..... *H01H 50/42* (2013.01); *H01H 1/54* (2013.01); *H01H 50/28* (2013.01); *H01H 50/54* (2013.01); *H01H 50/646* (2013.01); *H01H 51/2281* (2013.01); *H01H 50/04* (2013.01); *H01H 50/56* (2013.01); *H01H 50/643* (2013.01); *H01H 2050/362* (2013.01); *H01H 2203/004* (2013.01)

(58) Field of Classification Search

CPC ..... H01H 1/54

See application file for complete search history.

(56) References Cited

FOREIGN PATENT DOCUMENTS

| | | |
|---|---|---|
| EP | 3021341 | 5/2016 |
| JP | H4-19937 | 1/1992 |
| JP | H07-021890 | 1/1995 |

*Primary Examiner* — Ramon M Barrera

(74) *Attorney, Agent, or Firm* — IPUSA, PLLC

(57) ABSTRACT

An electromagnetic relay includes a movable terminal including a movable contact, a fixed terminal including a fixed contact that faces the movable contact, first irons disposed on one of the fixed terminal and the movable terminal, and a second iron disposed on another one of the fixed terminal and the movable terminal such that the second iron at least partially overlaps both of the first irons.

9 Claims, 13 Drawing Sheets

ELECTROMAGNETIC RELAY

CROSS-REFERENCE TO RELATED APPLICATION

The present application is based upon and claims the benefit of priority of Japanese Patent Application No. 2017-126249, filed on Jun. 28, 2017, the entire contents of which are incorporated herein by reference.

BACKGROUND OF THE INVENTION

1. Field of the Invention

An aspect of this disclosure relates to an electromagnetic relay.

2. Description of the Related Art

There is a known phenomenon in an electromagnetic relay in which, when a high current (e.g., a current of about 1-10 kA) is supplied to closed contacts, the electromagnetic repulsion between the contacts increases due to the high current and the contacts are opened. When the high current is supplied, an arc discharge may occur between the opened contacts, and the contacts melted by the arc discharge may be fused together.

Japanese Laid-Open Patent Publication No. H07-021890 discloses irons provided on a fixed terminal and a movable spring, such that attraction due to a magnetic flux generated by an electric current flowing through the fixed terminal and the movable terminal is generated in a direction opposite the direction of electromagnetic repulsion between contacts. With this configuration, however, the fixed iron is disposed to surround the fixed terminal, and a space around the fixed terminal to accommodate the fixed iron is necessary.

SUMMARY OF THE INVENTION

In an aspect of this disclosure, there is provided an electromagnetic relay that includes a movable terminal including a movable contact, a fixed terminal including a fixed contact that faces the movable contact, first irons disposed on one of the fixed terminal and the movable terminal, and a second iron disposed on another one of the fixed terminal and the movable terminal such that the second iron at least partially overlaps both of the first irons.

DESCRIPTION OF EMBODIMENTS

Figure 1:
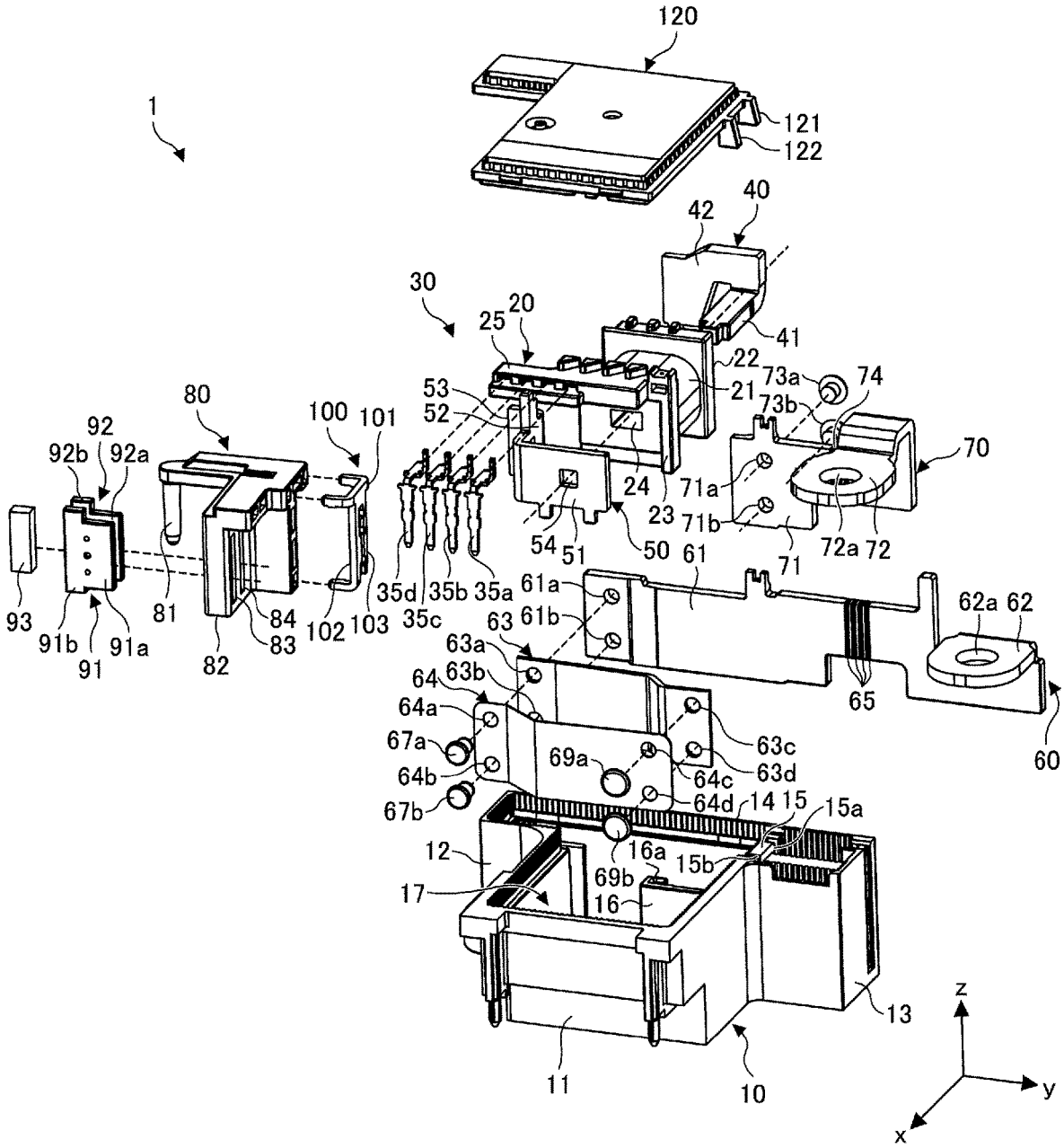
FIG. 1 is an exploded perspective view of an electromagnetic relay.

Embodiments of the present invention are described below with reference to the accompanying drawings. The same reference number is assigned to the same component in the drawings, and repeated descriptions of the component are omitted.

First Embodiment

Figure 2:
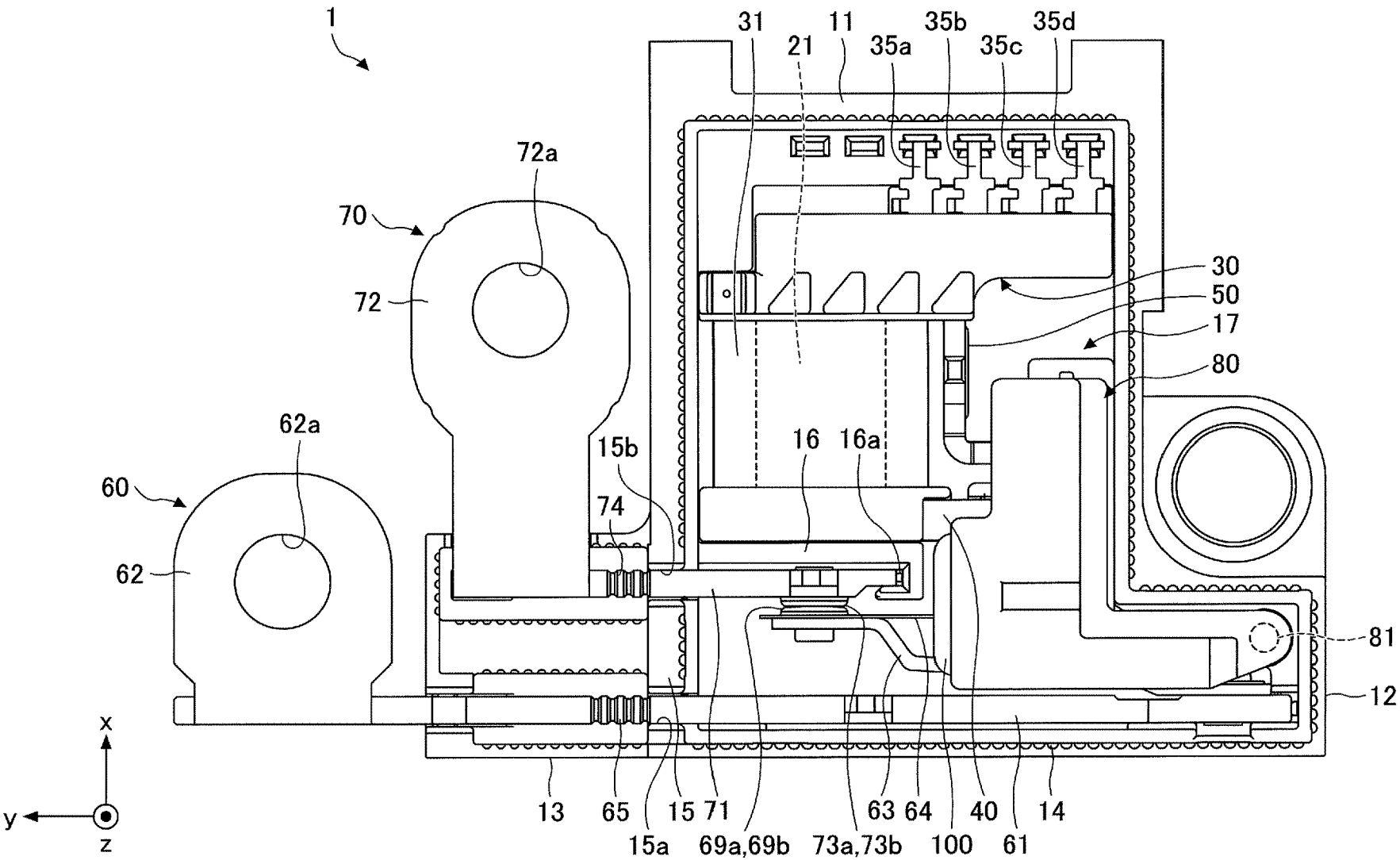
FIG. 2 is a drawing illustrating an electromagnetic relay in a closed state.
Figure 3:
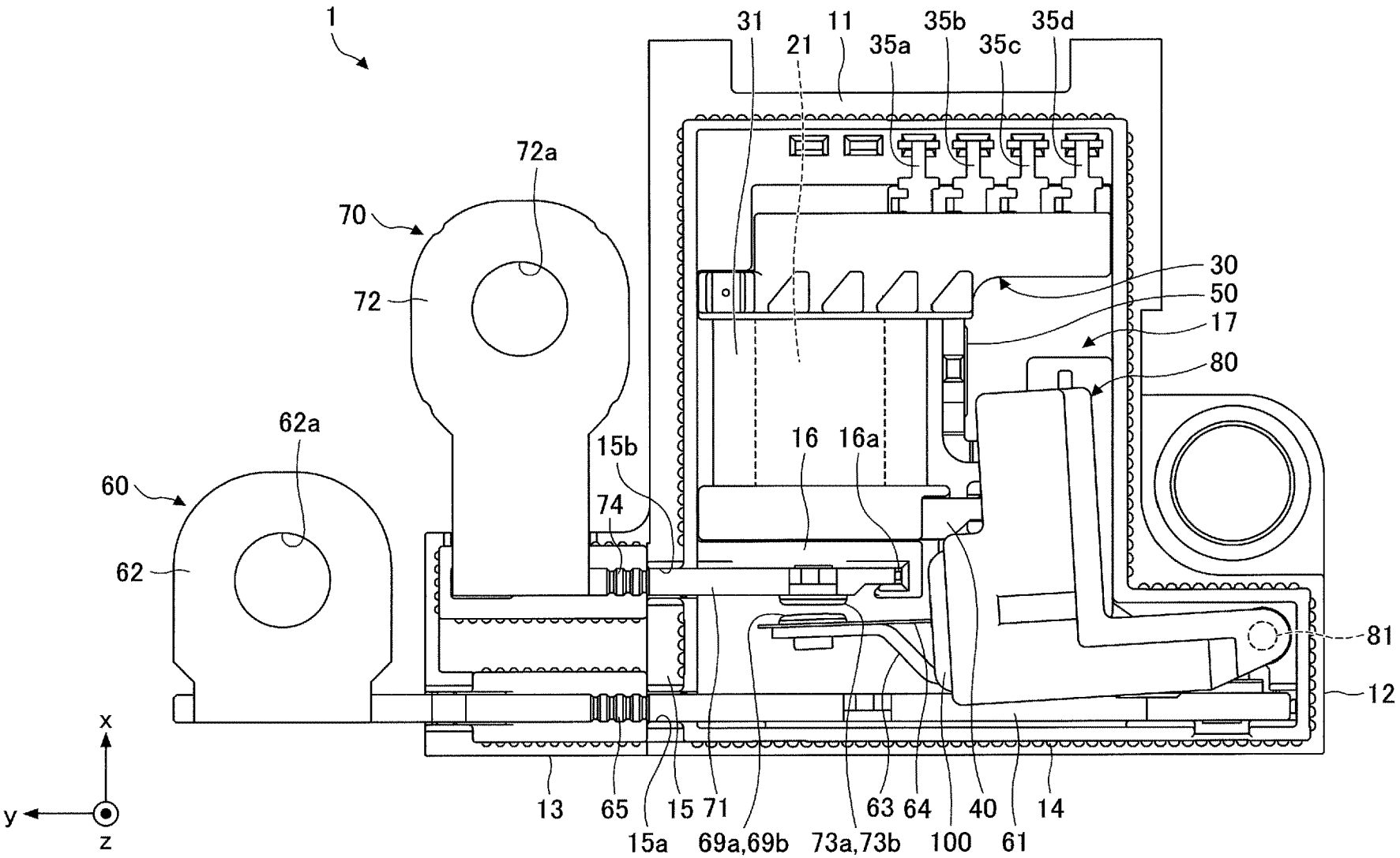
FIG. 3 is a drawing illustrating an electromagnetic relay in an open state.

An electromagnetic relay 1 according to a first embodiment is described with reference to FIGS. 1 through 3. FIG. 1 is an exploded perspective view of the electromagnetic relay 1. FIG. 2 is a drawing illustrating the electromagnetic relay 1 in a closed state. FIG. 3 is a drawing illustrating the electromagnetic relay 1 in an open state.

The electromagnetic relay 1 illustrated in FIGS. 1 through 3 is an example, and the embodiment is not limited to this example. Fixed irons 75*a* and 75*b* and a movable iron 66 described later are omitted in FIGS. 1 through 3.

The electromagnetic relay 1 is a polarized electromagnetic relay using a permanent magnet 93 and configured to connect and disconnect a movable terminal 60 that is a bus bar terminal to and from a fixed terminal 70. The movable terminal 60 and the fixed terminal 70 are connected to a target device such as a vehicle engine starter. In this case, an electric current supplied to the engine starter flows between the movable terminal 60 and the fixed terminal 70. The electromagnetic relay 1 supplies the electric current to the engine starter by connecting the movable terminal 60 to the fixed terminal 70, and stops supplying the electric current to the engine starter after the engine is started or in an emergency by disconnecting the movable terminal 60 and the fixed terminal 70. Internal devices of the electromagnetic relay 1 are enclosed by a base 10 and a cover 120, and connectors 62 and 72 of the movable terminal 60 and the fixed terminal 70 to be connected to the target device and coil terminals 35*a* through 35*d* for inputting signals for controlling connection and disconnection operations are exposed.

In the descriptions below, three axes (x-axis, y-axis, and z-axis) that are orthogonal to each other as illustrated in FIG. 1 are used as references in explaining shapes and positional relationships of components of the electromagnetic relay 1. A +x direction indicates a direction in which movable contacts 69*a* and 69*b* (collectively referred to as "movable contacts 69") move toward fixed contacts 73*a* and 73*b* (collectively referred to as "fixed contacts 73"), and a −x direction indicates a direction in which the movable contacts move away from the fixed contacts 73. A +y direction faces ends of the movable terminal 60 and the fixed terminal 70 at which the connectors 62 and 72 are provided, and a −y direction faces the other ends of the movable terminal 60 and the fixed terminal 70. A +z direction faces the cover 120 placed on the base 10, and a −z direction faces the base 10. For example, the z-axis corresponds to a vertical direction, and the x-axis and the y-axis correspond to horizontal directions.

As illustrated in FIG. 1, the electromagnetic relay 1 includes the box-shaped base 10. The base 10 is formed by molding a resin and includes a center part 11 having a rectangular shape and extension parts 12 and 13 protruding along an outer wall 14. The extension part 12 protrudes in the −y direction, and the extension part 13 protrudes in the +y direction from the center part 11, respectively. An internal space of the extension part 12 and an internal space of the center part 11 communicate with each other and form a housing 17 for housing an electromagnet 30 and an actuator 80. An internal space of the extension part 13 is separated from the housing 17 by an inner wall 15.

The opening of the base 10 is covered by the plate-shaped cover 120 formed by molding a resin. The cover 120 has a substantially L-shape and covers the center part 11 and the extension part 12. Protrusions 121 and 122 are formed at an end of the cover 120 adjoining the extension part 13. The protrusions 121 and 122 protrude to press the upper edges of plates 61 and 71 of the movable terminal 60 and the fixed terminal 70 at positions corresponding to grooves 15*a* and 15*b*.

The movable terminal 60 includes a flat plate 61 that extends along the inner surface of the outer wall 14. A groove 15*a* is formed in the inner wall 15. The groove 15*a* has a width that is slightly smaller than the thickness of the plate 61. The movable terminal 60 is pressed into the groove 15*a*. A −y end of the plate 61 extends to an end of the extension part 12.

The fixed terminal 70 includes a flat plate 71 that is pressed into a groove 15*b* formed in the inner wall 15.

The connectors 62 and 72 are formed at ends of the movable terminal 60 and the fixed terminal 70, respectively, and are bent from the plates 61 and 71 and extend in the +x direction.

The connectors 62 and 72 have configurations that are suitable to be connected with, for example, feeder lines. In the first embodiment, openings 62*a* and 72*a* are formed in the connectors 62 and 72 so that the movable terminal 60 and the fixed terminal can be coupled to a power-feeding target device by using bolts.

The −y end of the fixed terminal 70 extends only to a position near the center of the base 10. An inner wall 16 extending along the fixed terminal 70 is formed in the base 10. The inner wall 16 includes a groove 16*a* extending in the z-direction, and the −y end of the fixed terminal 70 is pressed into the groove 16*a*.

As illustrated in FIG. 1, two holes 61*a* and 61*b* arranged in the z-direction are formed in the plate 61 near its −y end. A flat braided wire 63 having holes 63*a* and 63*b* formed near the −y end and a movable spring 64 having holes 64*a* and 64*a* formed near the −y end are disposed on the +x side of the plate 61. The flat braided wire 63 and the movable spring 64 are attached to the plate 61 by two rivets 67*a* and 67*b* that pass through the holes 61*a*, 61*b*, 63*a*, 63*b*, 64*a*, and 64*b*, and forms parts of the movable terminal 60.

Holes 63*c* and 63*d* and holes 64*c* and 64*d* arranged in the z-direction are also formed, respectively, in +y ends of the flat braided wire 63 and the movable spring 64. The flat braided wire and the movable spring 64 are also joined together at the +y ends by flattening the rivet-shaped movable contacts 69*a* and 69*b* that pass through the holes 63*c*, 63*d*, 64*c*, and 64*d*.

The movable contacts 69 are disposed in positions that face the −y end of the plate 71. Rivet-shaped fixed contacts 73 are passed through holes 71*a* and 71*b* of the plate 71 and attached to the fixed terminal 70 at positions corresponding to the movable contacts 69. The movable contact 69*a* and the fixed contact 73*a*, and the movable contact 69*b* and the fixed contact 73*b*, are brought into a closed state where they are in contact with each other and into an open state where they are apart from each other, to switch the movable terminal 60 and the fixed terminal 70 between a conductive state and a non-conductive state.

As illustrated in FIGS. 1 through 3, an electromagnet 30 is pressed into the housing 17 at a position that is farther in the +x direction than the fixed terminal 70. The electromagnet 30 includes a bobbin 20 formed by molding a resin, an iron core 40, and a yoke 50.

As illustrated in FIG. 1, the bobbin 20 includes a cylinder 21 at the x ends of which flanges 22 and 23 are formed. As illustrated in FIGS. 2 and 3, a coil 31 is wound around the cylinder 21. In the first embodiment, the coil 31 is a double-winding type and two windings are wound around the bobbin 20. One of the windings functions as a coil to switch the contacts from the open state to the closed state, and another one of the windings functions as a coil to switch the contacts from the closed state to the open state. For brevity, the coil 31 is omitted in FIG. 1. The flanges 22 and 23 have a rectangular shape and the lower sides of the flanges 22 and 23 are placed in contact with the bottom surface of the base 10 so that the bobbin 20 is attached to the base 10 in a predetermined posture.

A through hole 24 that passes through the cylinder 21 and the flanges 22 and 23 is formed in the bobbin 20, and a rod 41 of the iron core 40 passes through the through hole 24. The through hole 24 and the rod 41 have rectangular cross sections that correspond to each other. The iron core 40 is held in the bobbin 20 by inserting the rod 41 into the through hole 24.

A plate 42 extending parallel to the flange 22 is joined to an end of the rod 41 that is closer to the flange 22. The plate 42 extends in the −y direction beyond the flange 22.

The yoke 50 includes a base plate 51 that extends parallel to the flange 23. The base plate 51 includes a hole 54 into which the rod 41 is fitted. The hole 54 have a rectangular cross section corresponds to the rod 41. The yoke 50 is held by the iron core 40 by inserting the rod 41 into the hole 54.

A portion of the base plate 51 extending in the −y direction beyond the flange 23 is bent in the −x direction and is connected to a middle plate 52 that extends parallel to the rod 41. The middle plate 52 is bent in the −y direction and is connected to an end plate 53 that extends parallel to the flanges 22 and 23.

The end plate 53 faces the plate 42. When a magnetic field is generated by the coil 31, a magnetic flux is transferred via the iron core 40 and the yoke 50 and a magnetic field is generated between the plate 42 and the end plate 53.

Four coil terminals 35*a*, 35*b*, 35*c*, and 35*d* are connected to the coil 31. The terminals 35*a* and 35*c* form one pair, and the terminals 35*b* and 35*d* form another pair. One of the windings is connected to the terminal 35*a* and the terminal 35*c*, and the other one of the windings is connected to the terminal 35*b* and the terminal 35*d*. The coil 31 is connected to the terminals 35*a* through 35*d* such that a magnetic field is generated in the +x direction when an electric current is supplied to the terminals 35*a* and 35*c*, and a magnetic field is generated in the −x direction when an electric current is supplied to the terminals 35*b* and 35*d*.

A terminal holder 25 to which the terminals 35*a*, 35*b*, 35*c*, and 35*d* are attached is formed as an integral part of the bobbin 20. The terminal holder 25 protrudes from an upper edge of the flange 23. The terminals 35*a*, 35*b*, 35*c*, and 35*d* are inserted into a +x end face of the terminal holder 25. Ends of the terminals 35*a*, 35*b*, 35*c*, and 35*d* are bent and extend in the −z direction, pass through an opening formed in the bottom of the base 10, and protrude out of the base 10.

As illustrated in FIGS. 1 through 3, the electromagnetic relay 1 includes an actuator 80 that is driven by a magnetic force of the electromagnet 30 and switches the movable terminal 60 and the fixed terminal 70 between the conductive state and the non-conductive state. The actuator 80 is formed by molding a resin, has an L-shape, and includes a shaft 81 disposed in a position corresponding to an end of the L-shape and extending in the z-direction. The shaft 81 is rotatably attached to the base 10, and the actuator 80 can rotate around the shaft 81. The actuator 80 is also housed in the housing 17.

Armatures 91 and 92 are attached to an end portion 82 of the actuator 80 that is located opposite the shaft 81. The armatures 91 and 92 are iron plates and fitted into holes 83 and 84 formed in the end portion 82 such that the armatures 91 and 92 are held by the actuator 80 and extend in the vertical direction parallel to each other. The armatures 91 and 92 are inserted into the holes 83 and 84 from the side of the end portion 82 facing the shaft 81, and include protrusions 91*a* and 92*a* that protrude from the opposite side of the end portion 82. Widened parts 91*b* and 92*b* protruding in the z-directions are formed at ends of the armatures 91 and 92 that are opposite the protrusions 91*a* and 92*a*. The armatures 91 and 92 are fixed to the actuator 80 by fitting the widened parts 91*b* and 92*b* into widened parts of the holes 83 and 84 (not shown).

The permanent magnet 93 is placed between the widened parts 91*b* and 92*b* and fitted into a groove formed in a surface of the end portion 82 facing the shaft 81. The armatures 91 and 92 are connected to the permanent magnet 93, and a constant magnetic field is consistently formed between the protrusions 91*a* and 92*a*.

The armature 92 is disposed such that the protrusion 92*a* is positioned between the plate 42 and the end plate 53. The armature 91 is disposed such that the protrusion 91*a* is positioned on the side of the end plate 53 opposite from the plate 42.

A force is applied to the armatures 91 and 92 as a result of interaction between the magnetic field between the protrusions 91*a* and 92*a* and the magnetic field between the plate 42 and the end plate 53 generated by the coil 31. The force is applied to the actuator 80 via the armatures 91 and 92 to rotate the actuator 80. The direction of the force applied to the armatures 91 and 92 can be changed between the +x direction and the −x direction by changing the direction of an electric current supplied to the coil 31.

A card 100 for transferring the movement of the actuator 80 to the movable contacts 69 is attached to the actuator 80. The card 100 is attached to the side of the actuator 80 from which the protrusions 91*a* and 92*a* protrude. The card 100 includes vertical strips 102 and 103 that are arranged in the x-direction and extend from an end part 101 in the −z direction parallel to each other. When the card 100 is attached to the actuator 80, the movable spring 64 is placed and held between the vertical strips 102 and 103.

Because the movable spring 64 is held by the card 100 attached to the actuator 80, the movable spring 64 is displaced along with the rotation of the actuator 80. Accordingly, the movable contacts 69 attached to the movable spring 64 also move in the same direction as the movable spring 64. When the actuator 80 is in a set position illustrated in FIG. 2, the movable contacts 69 contact the corresponding fixed contacts 73, and the movable terminal 60 and the fixed terminal 70 go into the conductive state. In contrast, when the actuator 80 is in a reset position illustrated in FIG. 3, the movable contacts 69 move away from the fixed contacts 73, and the movable terminal 60 and the fixed terminal 70 go into the non-conductive state.

Figure 4:
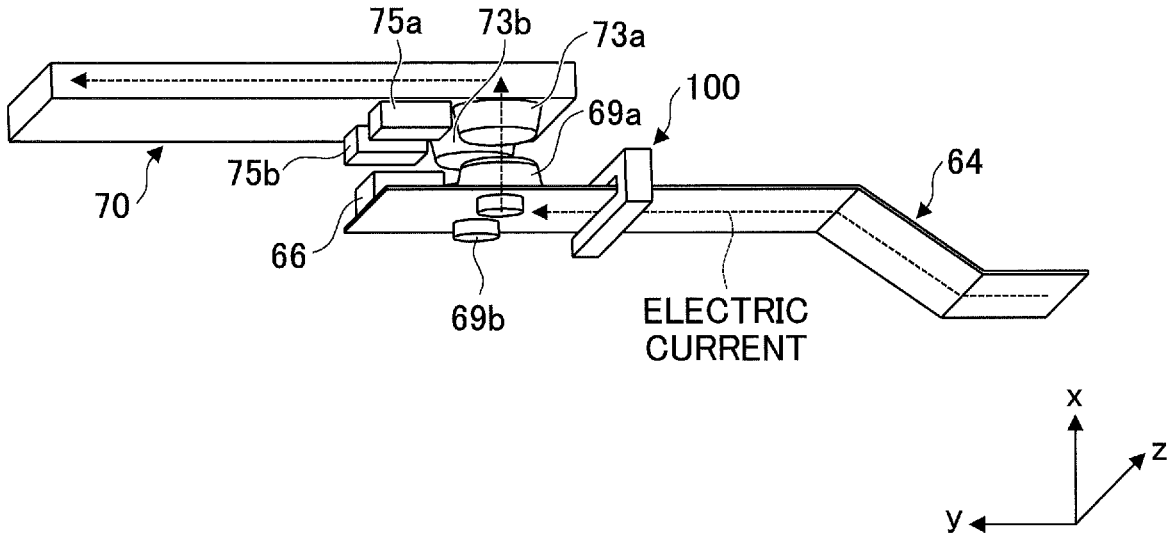
FIG. 4 is a perspective view of contacts according to a first embodiment.

Contacts of the electromagnetic relay 1, with surrounding components, is described with reference to FIGS. 4 through 9. FIG. 4 is a perspective view of contacts according to the first embodiment. As illustrated in FIG. 4, a pair of fixed irons 75*a* and 75*b* (collectively referred to as "fixed irons 75") (first irons) are provided on the fixed terminal 70, and one movable iron 66 (second iron) is provided on the movable spring 64 in the first embodiment.

The fixed irons 75*a* and 75*b* have a substantially cuboid shape and are disposed near the edges the fixed terminal 70 in the width direction facing the movable contacts 69. The fixed irons 75 extend in a direction that is substantially the same as the direction in which the fixed terminal 70 extends.

Similarly to the fixed irons 75, the movable iron 66 has a substantially cuboid shape, and is disposed such that the movable iron 66 extends in a direction that is substantially the same as the direction in which the movable spring extends. The movable iron 66 is provided on a surface of the movable spring 64 facing the fixed contacts 73. The movable iron 66 is disposed in the middle of the movable spring 64 in the width direction such that the movable iron 66 at least partially overlaps both of the facing fixed irons 75 when viewed from a direction in which the fixed terminal 70 and the movable spring 64 face each other.

The fixed irons 75 and the movable iron 66 may be fixed to the fixed terminal 70 and the movable spring 64 by soldering or welding. Alternatively, the fixed irons 75 and the movable iron 66 may be shaped like rivets and fixed to the fixed terminal 70 and the movable spring 64 by riveting. In this case, similarly to the movable contacts 69 and the fixed contacts 73 illustrated in FIG. 5, each of the fixed irons 75 and the movable iron 66 includes a head disposed on a surface of the fixed terminal 70 or the movable spring 64 and a trunk that passes through the fixed terminal 70 or the movable spring 64, and is fixed to the fixed terminal 70 or the movable spring 64 by plastically deforming the trunk protruding from the opposite surface of the fixed terminal 70 or the movable spring 64.

The movable spring 64 and the fixed terminal 70 are disposed such that their front ends face the opposite directions. In FIG. 4, the movable spring 64 is disposed such that its front end faces the +y direction, and the fixed terminal 70 is disposed such that its front end faces the −y direction. The fixed irons 75 are positioned closer to the rear end of the fixed terminal 70 than the fixed contacts 73. In contrast, the movable iron 66 is positioned closer to the front end of the movable spring 64 than the movable contacts 69. With this configuration, when an electric current flows between the fixed terminal 70 and the movable spring 64 in a dotted arrows direction in FIG. 4, the electric current flows the fixed terminal 70 at a position where the fixed irons 75 are located but does not flow at a position of the movable spring 64 where the movable iron 66 is located.

Figure 5:
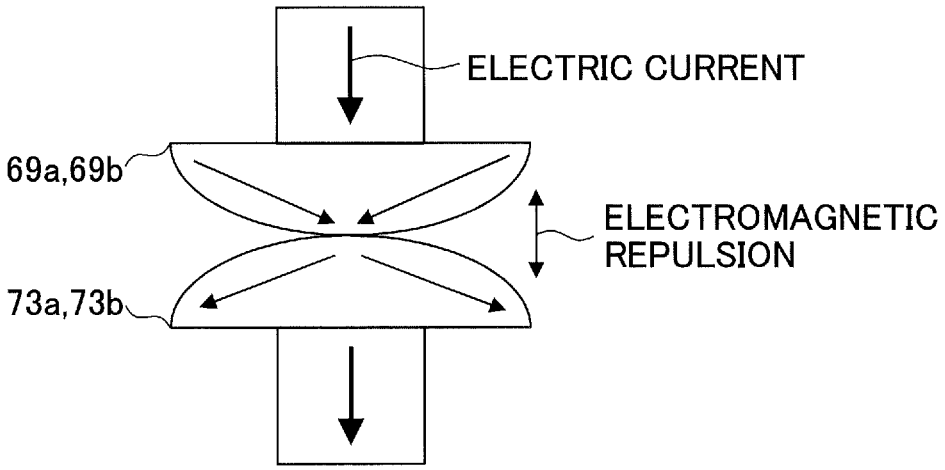
FIG. 5 is a drawing illustrating directions of an electric current flowing through contacts.
Figure 6:
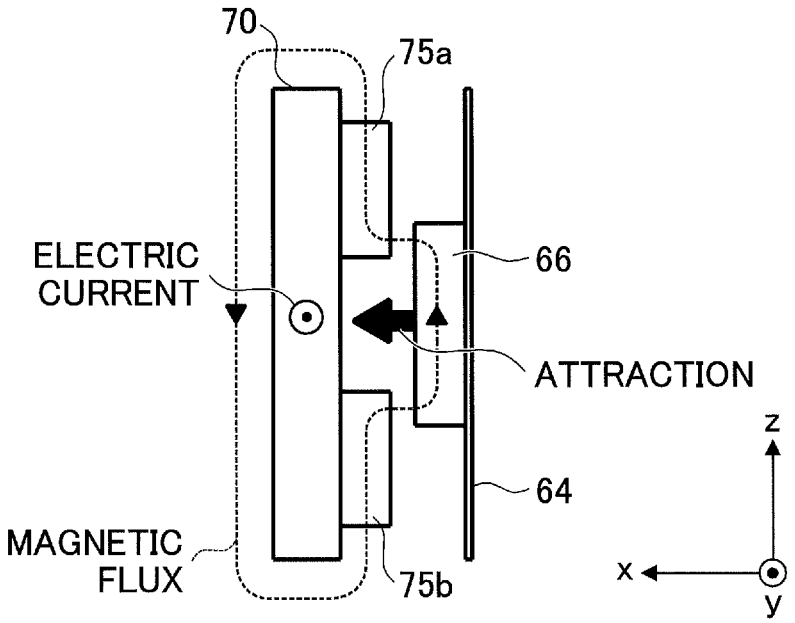
FIG. 6 is a drawing illustrating a magnetic flux generated between irons in the first embodiment.

FIG. 5 is a drawing illustrating directions of an electric current flowing between the fixed contacts 73 and the movable contacts 69. FIG. 6 is a drawing illustrating a magnetic flux generated between the fixed irons 75 and the movable iron 66.

An electric current flows from the movable spring 64 to the fixed terminal 70 via the movable contacts 69 and the fixed contacts 73 as indicated by dotted arrows in FIG. 4 in the closed state. In this case, as illustrated in FIG. 5, the movable contacts 69 and the corresponding fixed contacts 73 are in contact with each other at positions near the apexes of their hemispherical heads. The electric current flowing through the movable contact 69*a*/69*b* partially spreads toward the outer edge of the movable contact 69*a*/69*b*, flows along the surface of the movable contact 69*a*/69*b*, and converges at the center of the movable contact 69*a*/69*b*. The converged electric current flows from a point of contact between the movable contact 69*a*/69*b* and the fixed contact 73*a*/73*b* to the fixed contact 73*a*/73*b*. The electric current flowing into the fixed contact 73*a*/73*b* partially spread along the surface of the fixed contact 73*a*/73*b* toward the outer edge of the fixed contact 73*a*/73*b*, and converge again at the center of the fixed contact 73*a*/73*b*. Then, the converged electric current flows into the fixed terminal 70.

Thus, electric currents flow on the opposing surfaces of the movable contact 69*a*/69*b* and the fixed contact 73*a*/73*b* in opposite directions, and electromagnetic repulsion is generated between such electric currents. The electromagnetic repulsion increases as the electric current flowing between contacts increases (see FIG. 8). Electromagnetic attraction is generated between parallel conductors when electric currents flow in the same direction through the parallel conductors, and electromagnetic repulsion is generated between the parallel conductors when electric currents flow in the opposite directions through the parallel conductors.

When electromagnetic repulsion generated by supplying a high current of about 1 to 10 kA becomes large enough to open the contacts, an arc discharge that occurs between the opened contacts may melt the contacts and the melted contacts may fuse together. In the first embodiment, the fixed irons 75 and the movable iron 66 are arranged such that magnetic attraction is generated in a direction opposite the direction of electromagnetic repulsion by using a magnetic flux generated by a high current to prevent this problem.

When electric current flows in a direction illustrated in FIG. 4, the electric current flows through the fixed terminal 70 as illustrated in FIG. 6. In FIG. 6, the electric current flows in the +y direction. The electric current generates a magnetic flux around the fixed terminal 70. In FIG. 6, the magnetic flux is generated in the counterclockwise direction around the fixed terminal 70 when viewed from the +y side. The magnetic flux flows through the fixed irons 75 and also through the movable iron 66 facing the fixed irons 75 as shown in dotted line. Due to the function of a magnetic circuit formed as described above, magnetic attraction is generated in the movable iron 66 in a direction toward the fixed irons 75. The generated magnetic attraction acts in a direction opposite the direction of the electromagnetic repulsion illustrated in FIG. 5 and therefore can offset the electromagnetic repulsion. This can prevent the movable contacts 69 and the fixed contacts 73 in the closed state from being moved apart from each other by the electromagnetic repulsion.

Figure 7:
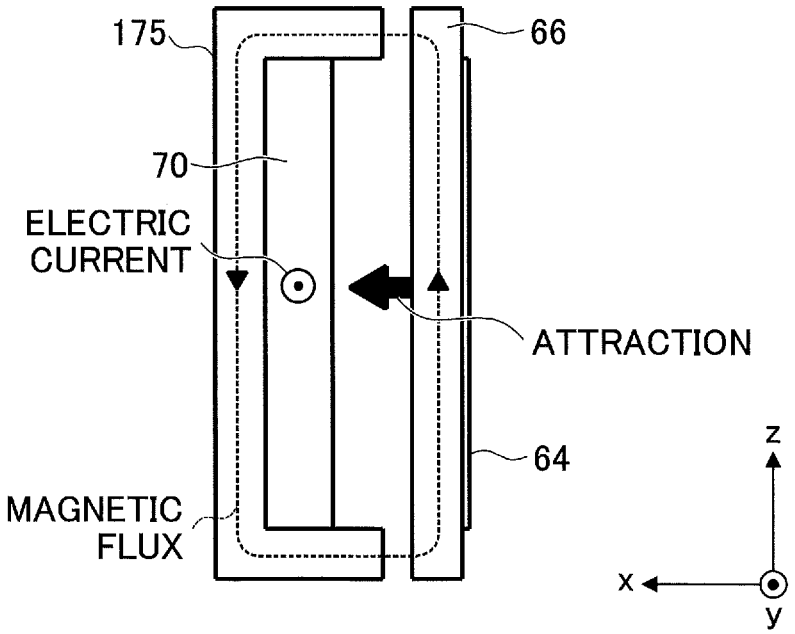
FIG. 7 is a drawing illustrating a magnetic flux generated between irons in a comparative example.

FIG. 7 illustrates a magnetic flux generated between irons in a comparative example. In the comparative example of FIG. 7, a square-bracket shaped fixed iron 175 is provided on the fixed terminal 70 such that attraction is generated between the fixed iron 175 and a movable iron 66 provided on the front end of the movable spring 64. In FIG. 7, the fixed iron 175 is disposed to extend across a back surface of the fixed terminal 70 which is opposite the surface facing the movable spring 64, and the side surfaces of the fixed terminal 70. Accordingly, a space for the fixed iron 175 on the outside of the fixed terminal 70 is required. Also, to form a magnetic circuit with this configuration, the movable iron 66 needs to be disposed to face the ends of the fixed iron 175 that are located outside of the fixed terminal 70 in the width direction, and the width of the movable iron 66 need to be greater than the width of the movable spring 64. Thus, the comparative example increases the sizes of the fixed iron 175 and the movable iron 66, and increases the size of an electromagnetic relay.

In the first embodiment, as illustrated in FIG. 6, the fixed irons 75*a* and 75*b* are provided on a surface of the fixed terminal 70 facing the movable terminal 60. The first embodiment eliminates the need to provide spaces on the back side and the lateral sides of the fixed terminal 70 to accommodate irons. Also, because the movable iron 66 is disposed to partially overlap the fixed irons 75*a* and 75*b*, the width of the movable iron 66 can be made smaller than the width of the movable spring 64. Thus, the first embodiment can reduce the sizes of the fixed irons 75*a* and 75*b* and the movable iron 66, and prevents an increase in the size of the electromagnetic relay 1. As described above, the first embodiment can provide an electromagnetic relay configured to prevent contacts from being opened due to electromagnetic repulsion generated between the contacts without increasing the size of the electromagnetic relay.

Figure 8:
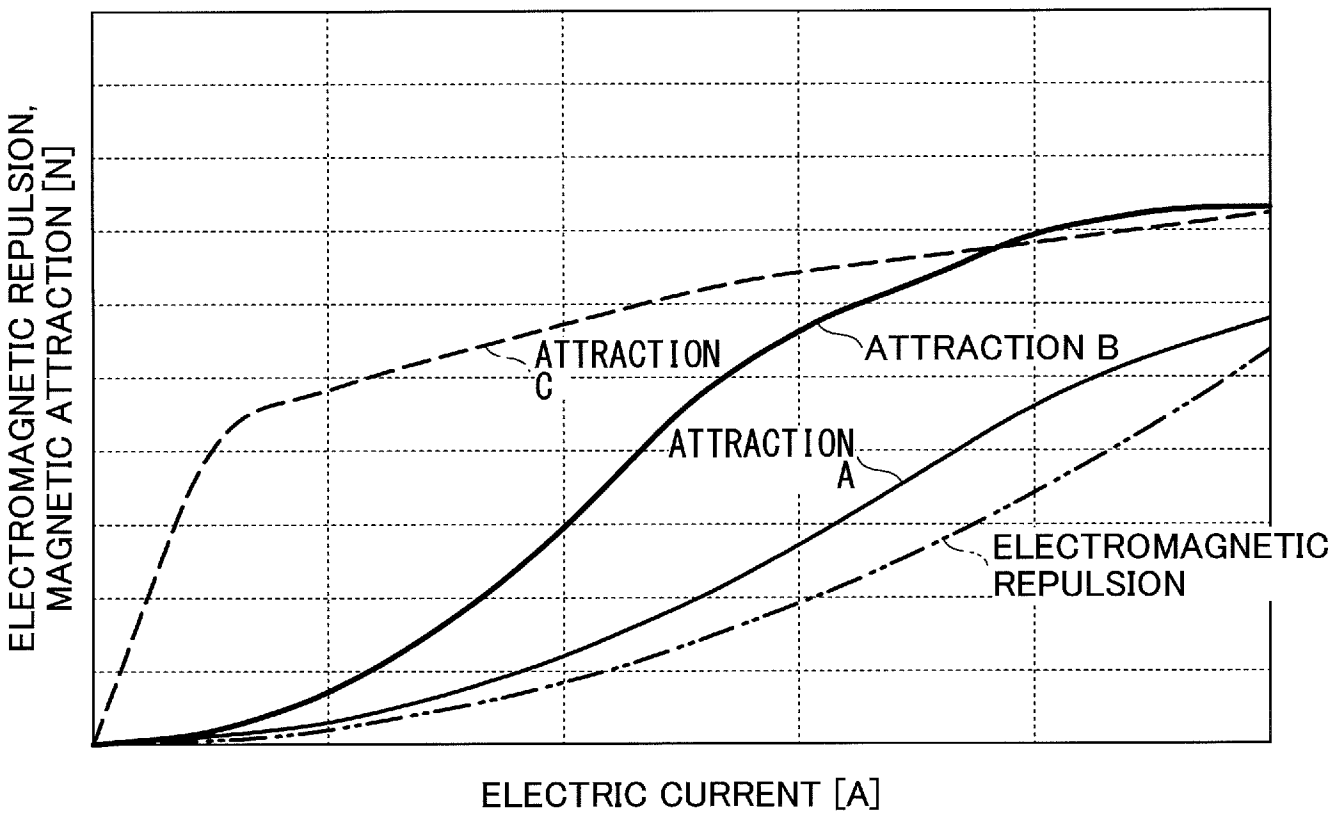
FIG. 8 is a graph illustrating simulation results of magnetic attraction between irons.

FIG. 8 is a graph illustrating simulation results of magnetic attraction between irons. In FIG. 8, the horizontal axis indicates the magnitude of an electric current flowing between contacts, and the vertical axis indicates electromagnetic repulsion and magnetic attraction generated by the electric current. A dashed-two dotted line indicates electromagnetic repulsion generated between contacts. A solid line indicates magnetic attraction A generated between irons of the first embodiment, and a dashed line indicates magnetic attraction C generated between irons of the comparative example.

As indicated by the dashed-two dotted line in FIG. 8, electromagnetic repulsion generated between contacts increases as the electric current increases. More specifically, as described later using formula (1), electromagnetic repulsion is proportional to the square of an electric current value.

As indicated by the solid line in FIG. 8, the magnetic attraction A generated between the irons of the first embodiment is consistently greater than the electromagnetic repulsion regardless of the electric current value. This indicates that the configuration of FIGS. 4 and 6 including the movable iron 66 and the fixed irons can reliably prevent the contacts from being opened due to electromagnetic repulsion generated between the contacts.

As indicated by the dashed line in FIG. 8, the magnetic attraction C generated between the irons of the comparative example is also consistently greater than the electromagnetic repulsion regardless of the electric current value. However, while the magnetic attraction A changes along with changes in the electromagnetic repulsion, the rate of change of the magnetic attraction C in relation to changes in the electric current is extremely high in a range where the electric current value is comparatively small, and is low in a range where the electric current value is comparatively large. Thus, in the comparative example, excessive attraction is generated even in a range where the electric current flowing between the contacts is small and only small attraction is necessary. Also, with the comparative example, the magnetic flux mostly passes through the irons in the magnetic circuit and passes through air only in the gaps between the fixed iron 175 and the movable iron 66, and the magnetic resistance of the magnetic circuit is small. For this reason, if the gaps between the fixed iron 175 and the movable iron 66 are narrow, magnetic attraction tends to remain between the fixed iron 175 and the movable iron 66 even after the supply of electric current to the contacts is cut off by, for example, a fuse. Thus, with the comparative example, it may become difficult to open the contacts.

In contrast, in the first embodiment, because the sizes of the fixed irons 75 and the movable iron 66 are small, the magnetic flux mostly passes through air in the magnetic circuit as illustrated in FIG. 6, and the magnetic resistance of the magnetic circuit becomes greater compared with the comparative example and residual magnetization is reduced. Also, as illustrated in FIG. 8, because the magnetic attraction A changes along with changes in the electromagnetic repulsion, the influence of the magnetic attraction A on an opening operation of the contacts while the electric current is being supplied is small. Thus, with the first embodiment, the attraction does not hamper the opening operation of the contacts and does not influence operations of the electromagnetic relay 1, even when the supply of an electric current to the contacts is stopped after attraction is generated between the irons as the electric current is supplied to the contacts.

In the electromagnetic relay 1 of the first embodiment, the fixed irons 75 are provided on a surface of the fixed terminal 70 facing the movable contacts 69, and do not protrude beyond the edges of the fixed terminal 70. This configuration can prevent an increase in the size of the electromagnetic relay 1.

Also in the first embodiment, the width of the movable iron 66 is less than the width of the movable spring 64. Therefore, the weight of the movable iron 66 attached to an end of the movable spring 64 can be reduced, thereby reduce the influence of the movable iron 66 on the movement of the movable spring 64, and improve the shock resistance and the vibration resistance of the electromagnetic relay 1. In this point of view, it is preferable to further reduce the width of the movable iron 66 relative to the width of the movable spring 64 and further reduce the weight of the movable iron 66.

In the first embodiment, multiple pairs (in FIG. 4, two pairs) of fixed contacts (73*a*, 73*b*) and movable contacts (69*a*, 69*b*) are provided. This configuration can reduce electromagnetic repulsion generated between contacts. Electromagnetic repulsion generated when one pair of contacts is provided is represented by formula (1) below.

$$F=a\times I^2 \quad (1)$$

In formula (1), "F" indicates electromagnetic repulsion, "a" indicates a coefficient corresponding to, for example, a shape of the contacts, and "I" indicates an electric current.

Electromagnetic repulsion generated when two pairs of contacts are provided is represented by formula (2) below.

$$F=a\times(I/2)^2+a\times(I/2)^2=a\times I^2/2 \quad (2)$$

Thus, if an electric current is evenly distributed to two pairs of contacts, the electromagnetic repulsion becomes one half of the electromagnetic repulsion in a case where one pair of contacts is provided. The electromagnetic repulsion decreases as the number of pairs of contacts increases.

Figure 9:
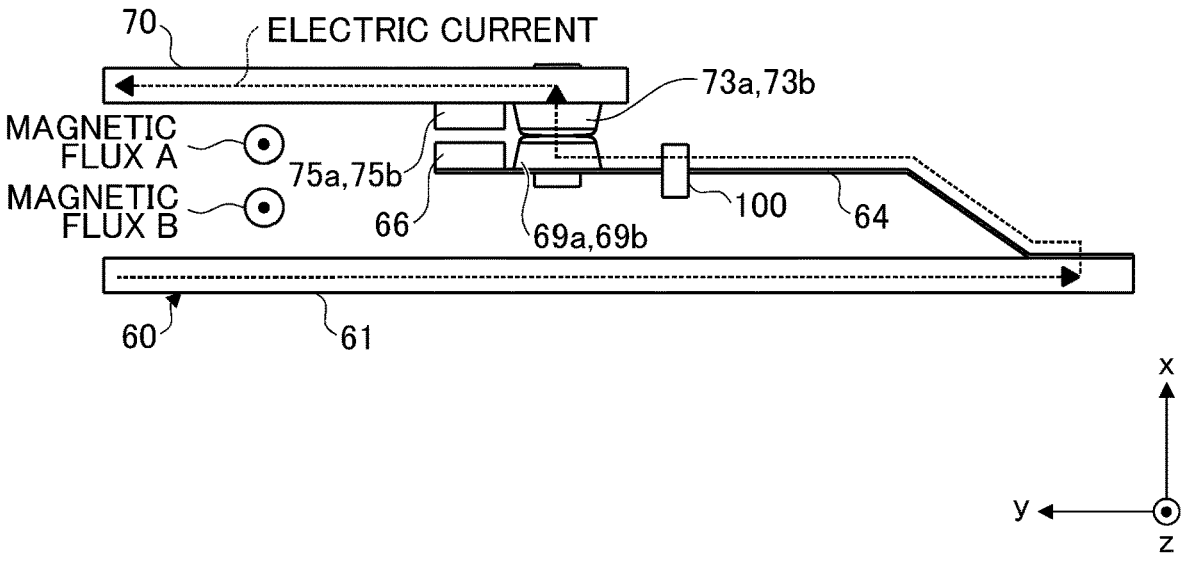
FIG. 9 is a drawing illustrating magnetic fluxes generated in a fixed terminal and a movable terminal.

As illustrated in FIG. 9, the movable terminal 60 to which the movable spring 64 is attached and the fixed terminal 70 are disposed to face each other such that electric currents flow through the fixed terminal 70 and the movable terminal 60 in opposite directions when the fixed terminal 70 and the movable terminal 60 are connected to each other.

In FIG. 9, the direction of a magnetic flux A generated by the electric current flowing through the fixed terminal 70 becomes the same as the direction of a magnetic flux B generated by the electric current flowing through the movable terminal 60. Therefore, attraction generated by the magnetic flux B between the irons can be increased. A thick line in FIG. 8 indicates the characteristic of magnetic attraction B between irons, which is calculated taking into account both of the magnetic flux A and the magnetic flux B. Because both of the magnetic flux A and the magnetic flux B work on the magnetic attraction B, the magnetic attraction B is constantly greater than the magnetic attraction A calculated taking into account only the magnetic flux A.

Compared with the magnetic attraction C of the comparative example, the magnetic attraction B has a characteristic closer to the characteristic of the electromagnetic repulsion and changes along with changes in the electromagnetic repulsion as the electric current increases. Further, different from the comparative example, the rate of increase of the magnetic attraction B relative to the electromagnetic repulsion becomes higher as the electric current increases. This indicates that the configuration of FIG. 9 can more reliably reduce the influence of electromagnetic repulsion in a high current range where the influence of electromagnetic repulsion becomes prominent.

When supplying a high current, it is necessary to increase the contact force between contacts to prevent static welding, where contacts are locally melted by an electric current and fused together. Accordingly, it is desirable to increase the contact force between contacts by making the magnetic attraction greater than the electromagnetic repulsion. However, excessive magnetic attraction in a low current range as in the comparative example hampers the normal opening operation of the contacts. Therefore, it is preferable that the magnetic attraction gradually increases along with an increase in the electric current.

In the first embodiment, multiple pairs of fixed contacts and movable contacts are provided. However, only one pair of a fixed contact and a movable contact may be provided.

Second Embodiment

Figure 10:
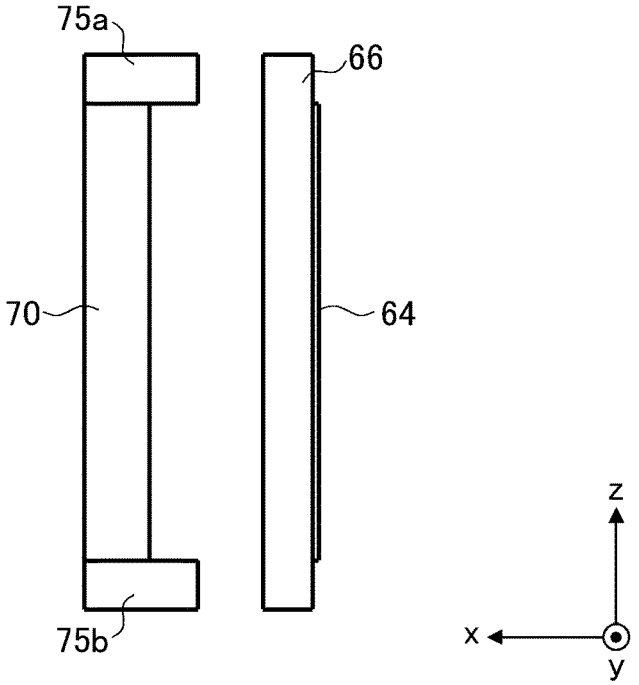
FIG. 10 is a drawing illustrating an arrangement of irons according to a second embodiment.

A second embodiment is described with reference to FIG. 10. FIG. 10 is a drawing illustrating an arrangement of irons according to the second embodiment.

As illustrated in FIG. 10, fixed irons 75*a* and 75*b* are provided on side surfaces of the fixed terminal 70 that are apart from each other in the z-direction that is orthogonal to the direction in which the fixed terminal extends. In the second embodiment, a movable iron 66 has a width greater than the width of the movable spring 64 so as to overlap both of the fixed irons 75*a* and 75*b*.

With the configuration of the second embodiment, magnetic attraction is generated in the movable iron 66 in a direction toward the fixed irons 75 due to a magnetic flux generated by an electric current flowing through the fixed terminal 70. Similarly to the first embodiment, this magnetic attraction prevents contacts from being opened due to electromagnetic repulsion generated between the contacts.

Third Embodiment

Figure 11:
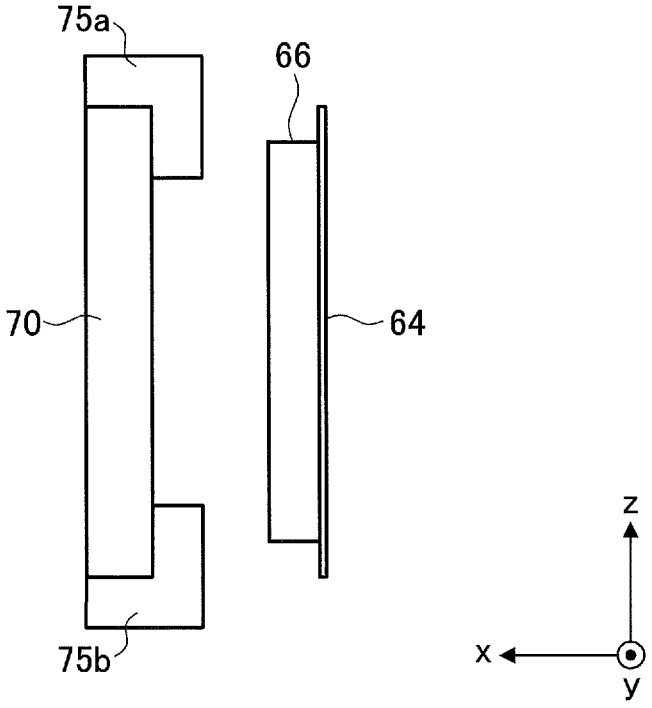
FIG. 11 is a drawing illustrating an arrangement of irons according to a third embodiment.

A third embodiment is described with reference to FIG. 11. FIG. 11 is a drawing illustrating an arrangement of irons according to the third embodiment.

As illustrated in FIG. 11, each of fixed irons 75*a* and 75*b* is disposed to extend from a side surface of the fixed terminal 70 to a surface of the fixed terminal 70 facing the movable contacts 69. In the third embodiment, each of the fixed irons 75*a* and 75*b* has a substantially-L shape when viewed from the y-direction. The movable iron 66 has a width that is less than the width of the movable spring 64 but is sufficient to overlap both of the fixed irons 75*a* and 75*b*.

With the configuration of the third embodiment, magnetic attraction is generated in the movable iron 66 in a direction toward the fixed irons 75 due to a magnetic flux generated by an electric current flowing through the fixed terminal 70. This magnetic attraction prevents contacts from being opened due to electromagnetic repulsion generated between the contacts.

Compared with FIG. 10, the configuration of FIG. 11 where parts of the fixed irons 75*a* and 75*b* extend inward can reduce the width of the movable iron 66.

Fourth Embodiment

Figure 12A:
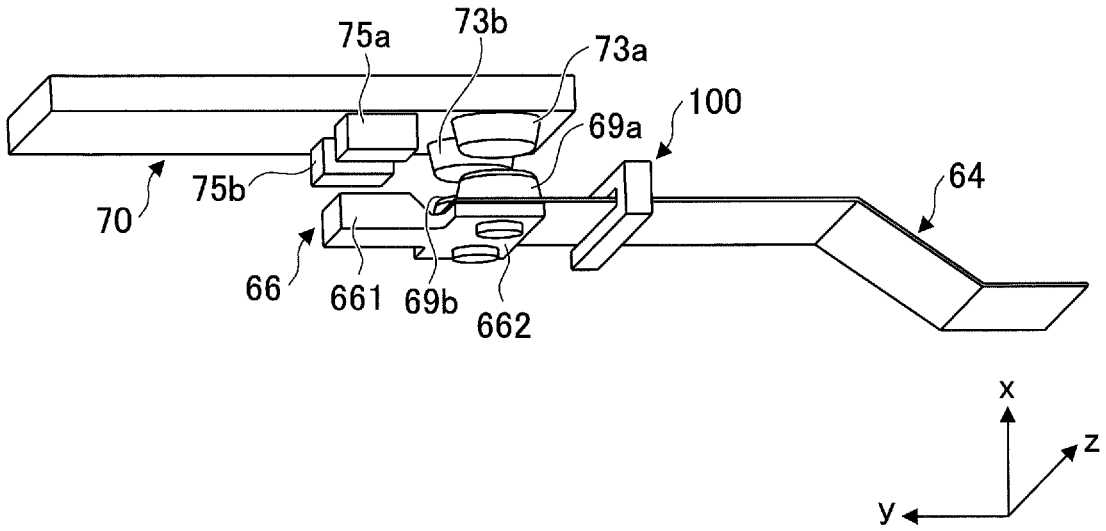
FIG. 12A is a perspective view of contacts according to a fourth embodiment.

A fourth embodiment is described with reference to FIG. 12. FIG. 12A is a perspective view of contacts according to the fourth embodiment, and FIG. 12B is a perspective view of a movable iron 66.

Figure 12B:
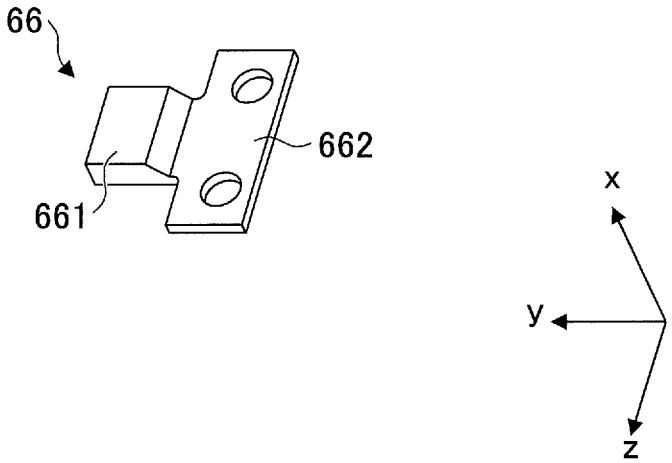
FIG. 12B is a perspective view of a movable iron.

As illustrated in FIGS. 12A and 12B, the movable iron 66 is riveted to the movable spring 64 by the movable contacts 69*a* and 69*b*.

The movable iron 66 includes a plate 662 that is disposed on a front end of the movable spring 64 and an iron 661 that extends from the plate 662 beyond the front end of the movable spring 64. The movable iron 66 is fixed to the movable spring 64 by placing the plate 662 on the movable spring 64 and riveting the movable contacts 69*a* and 69*b* passing through the movable spring 64 and the plate 662. The movable iron 66 is disposed such that the iron 661 partially overlaps both of the fixed irons 75*a* and 75*b*.

With the configuration of FIGS. 12A and 12B, the movable iron 66 can be fixed to the movable spring 64 together with the movable contacts 69, and the number of joints is reduce and improve the ease of manufacturing.

When two movable irons 66*a* and 66*b* (collectively referred to as "movable irons 66") and one fixed iron 75 is employed as described in a ninth embodiment (see FIG. 18), the fixed iron 75 may have a structure similar to the movable iron 66 of the fourth embodiment and may be riveted to the fixed terminal 70 using a fixed contact 73.

Fifth Embodiment

Figure 13:
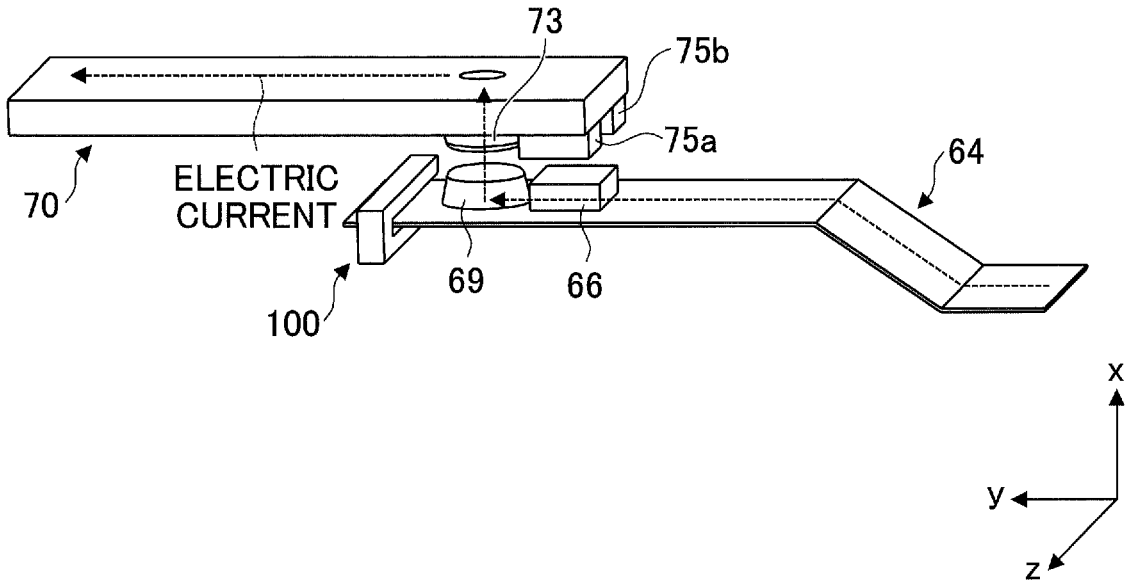
FIG. 13 is a perspective view of contacts according to a fifth embodiment.
Figure 14:
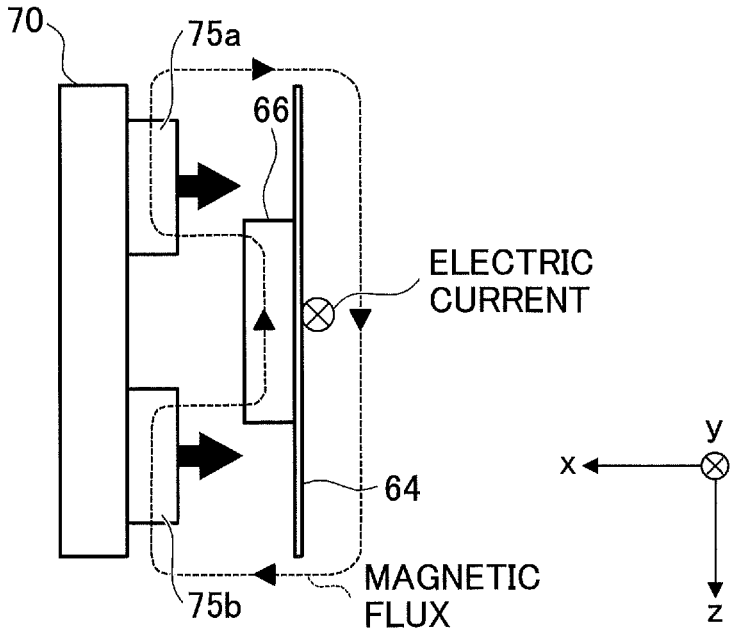
FIG. 14 is a drawing illustrating a magnetic flux generated between irons in the fifth embodiment.

A fifth embodiment is described with reference to FIGS. 13 and 14. FIG. 13 is a perspective view of contacts according to the fifth embodiment. FIG. 14 is a drawing illustrating a magnetic flux generated between irons. In the descriptions below, a configuration including one pair of a fixed contact and a movable contact may be used. However, multiple pairs of contacts may be provided as in the first embodiment.

As illustrated in FIG. 13, fixed irons 75*a* and 75*b* are disposed on the fixed terminal 70 at a position closer to the front end of the fixed terminal 70 than a fixed contact 73 and a movable iron 66 is disposed on the movable spring 64 at a position closer to the rear end of the movable spring 64 than a movable contact 69. With this configuration, different from the first embodiment, when an electric current flows between the fixed terminal 70 and the movable spring 64, the electric current flows at a position of the movable spring where the movable iron 66 is located and does not flow at a position of the fixed terminal 70 where the fixed irons 75 are located.

When electric current flows in a direction illustrated in FIG. 13, the electric current flows through the movable spring 64 in the +y direction as illustrated in FIG. 14. The electric current generates a magnetic flux around the movable spring 64. In FIG. 14, the magnetic flux is generated in the clockwise direction around the movable spring 64 when viewed from the −y side. The magnetic flux also flows through the movable iron 66 provided on the movable spring 64 and the fixed irons 75 disposed to face the movable iron 66. Due to the function of a magnetic circuit formed as described above, magnetic attraction is generated in the fixed irons 75 in a direction toward the movable iron 66. The magnetic attraction acts in a direction opposite the direction of the electromagnetic repulsion (see FIG. 5) between the fixed contact 73 and the movable contact 69 and therefore can offset the electromagnetic repulsion. Thus, the above configuration can prevent contacts from being opened due to electromagnetic repulsion between the contacts in the closed state.

In FIG. 13, the card 100 is joined to the movable spring 64 at a position closer to the front end of the movable spring 64 than the movable contact 69. However, the card 100 may be joined to the movable spring 64 at a position closer to the rear end of the movable spring 64 than the movable contact 69.

Sixth Embodiment

Figure 15:
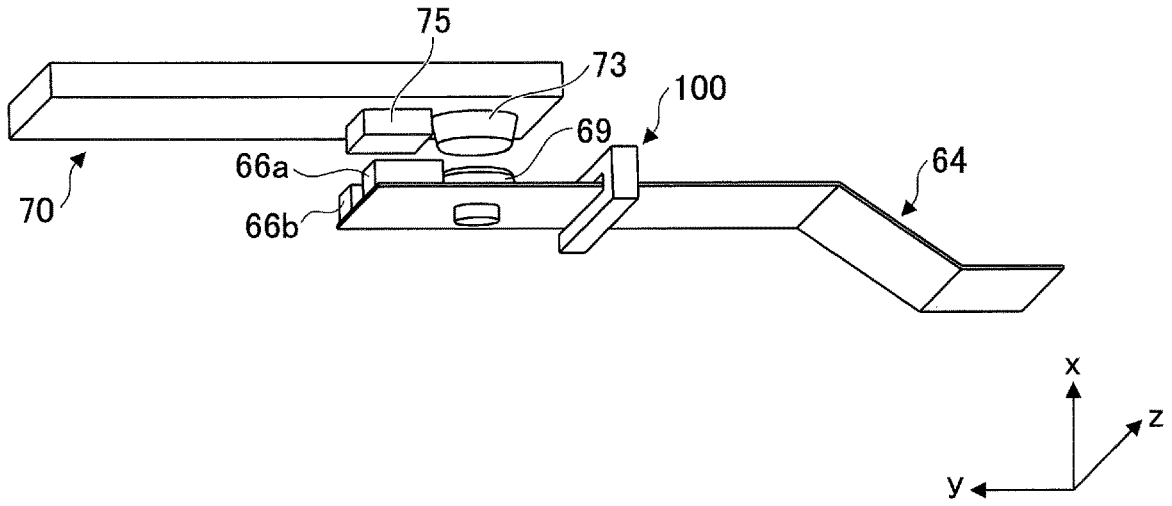
FIG. 15 is a perspective view of contacts according to a sixth embodiment.

A sixth embodiment is described with reference to FIG. 15. FIG. 15 is a perspective view of contacts according to the sixth embodiment.

As illustrated in FIG. 15, a pair of movable irons 66*a* and 66*b* are provided on the movable spring 64, and one fixed iron 75 is provided on the fixed terminal 70. Thus, in the sixth embodiment, the number of fixed irons and the number of movable irons in the first through fifth embodiments are reversed. In the sixth embodiment, the movable irons 66*a* and 66*b* correspond to first irons and the fixed iron 75 corresponds to a second iron.

The movable irons 66 are provided on a surface of the movable spring 64 facing the fixed contact 73. The fixed iron 75 is provided on a surface of the fixed terminal 70 facing the movable contact 69.

In the sixth embodiment, magnetic attraction is generated between the fixed iron 75 and the movable irons 66. Accordingly, the sixth embodiment can also prevent contacts from being opened due to electromagnetic repulsion generated between the contacts.

Seventh Embodiment

Figure 16:
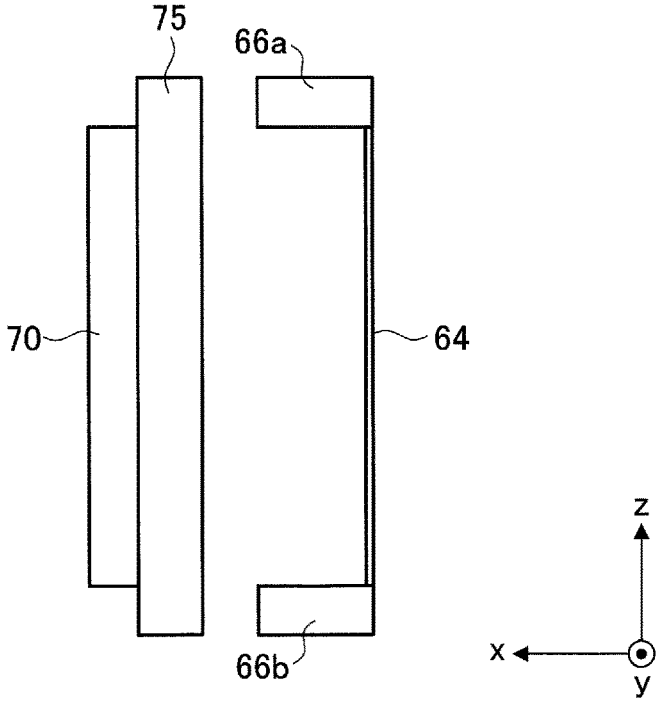
FIG. 16 is a drawing illustrating an arrangement of irons according to a seventh embodiment.

A seventh embodiment is described with reference to FIG. 16. FIG. 16 is a drawing illustrating an arrangement of irons according to the seventh embodiment. As illustrated in FIG. 16, a pair of movable irons 66*a* and 66*b* are provided on the movable spring 64, and one fixed iron 75 is provided on the fixed terminal 70. Thus, in the seventh embodiment, the number of fixed irons and the number of movable irons in the second embodiment are reversed.

The movable irons 66 are provided on the side edges of the movable spring 64 that are apart from each other in the z-direction. The fixed iron 75 has a width greater than the width of the fixed terminal 70 so as to overlap both of the movable irons 66*a* and 66*b*.

In the seventh embodiment, magnetic attraction is generated between the fixed iron 75 and the movable irons 66. Accordingly, the seventh embodiment can also prevent contacts from being opened due to electromagnetic repulsion generated between the contacts.

Eighth Embodiment

Figure 17:
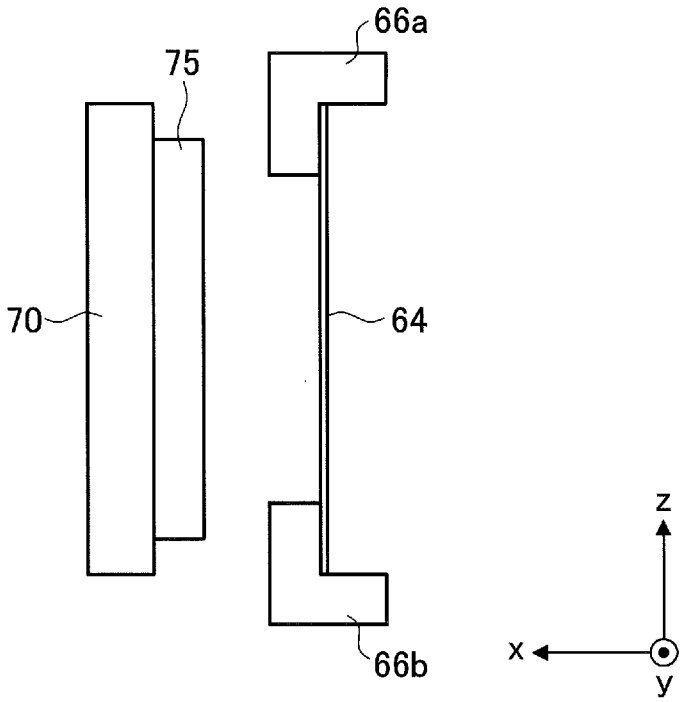
FIG. 17 is a drawing illustrating an arrangement of irons according to an eighth embodiment.

An eighth embodiment is described with reference to FIG. 17. FIG. 17 is a drawing illustrating an arrangement of irons according to the eighth embodiment. As illustrated in FIG. 17, a pair of movable irons 66*a* and 66*b* are provided on the movable spring 64, and one fixed iron 75 is provided on the fixed terminal 70.

Each of the movable irons 66*a* and 66*b* is disposed to extend from a side surface of the movable spring 64 to an edge of a surface of the movable spring 64 facing the fixed contact 73. Each of the movable irons 66*a* and 66*b* has a substantially-L shape. Also, the fixed iron 75 has a width that is less than the width of the fixed terminal 70 but is sufficient to overlap both of the movable irons 66*a* and 66*b*.

In the eighth embodiment, similarly to the third embodiment, magnetic attraction is generated between the fixed iron 75 and the movable irons 66. Accordingly, the eighth embodiment can also prevent contacts from being opened due to electromagnetic repulsion generated between the contacts.

Ninth Embodiment

Figure 18:
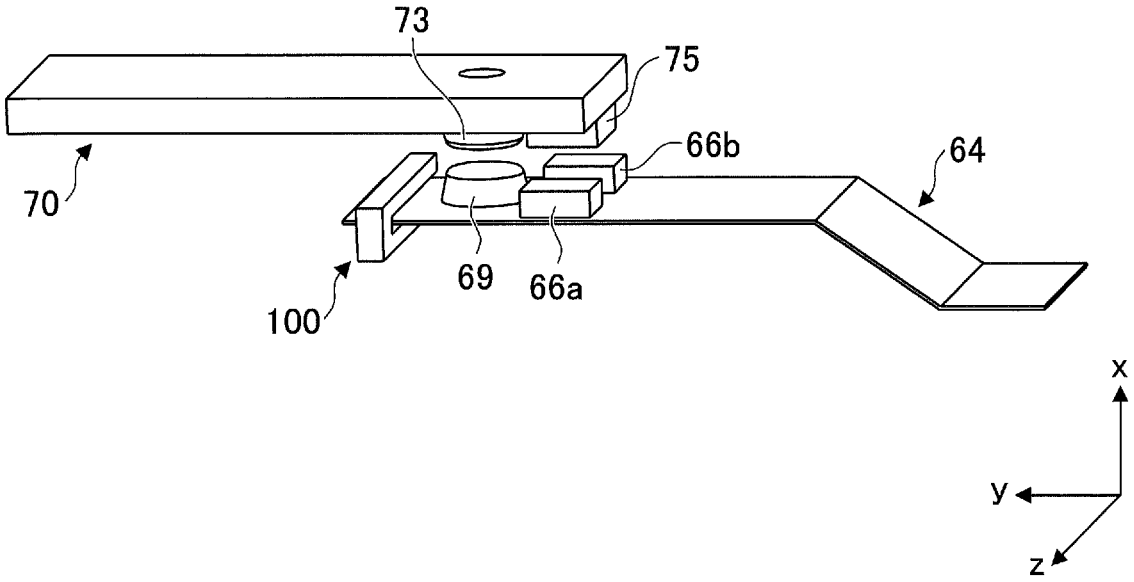
FIG. 18 is a perspective view of contacts according to a ninth embodiment.

A ninth embodiment is described with reference to FIG. 18. FIG. 18 is a perspective view of contacts according to the ninth embodiment.

As illustrated in FIG. 18, in the ninth embodiment, a pair of movable irons 66*a* and 66*b* are provided on the movable spring 64, and one fixed iron 75 is provided on the fixed terminal 70. The fixed iron 75 is disposed on the fixed terminal 70 at a position closer to the front end of the fixed terminal 70 than the fixed contact 73 and the movable irons 66 are disposed on the movable spring 64 at a position closer to the rear end of the movable spring 64 than the movable contact 69. With the ninth embodiment, magnetic attraction is generated between the fixed iron 75 and the movable irons 66. Accordingly, the ninth embodiment can also prevent contacts from being opened due to electromagnetic repulsion generated between the contacts.

Similarly to FIGS. 12A and 12B, the fixed iron 75 may be configured to include a plate disposed on the front end of the fixed terminal 70 and an iron part extending from the plate beyond the front end of the fixed terminal 70, and the fixed iron 75 may be fixed to the fixed terminal 70 by placing the plate on the fixed terminal 70 and riveting the fixed contact 73.

Tenth Embodiment

Figure 19:
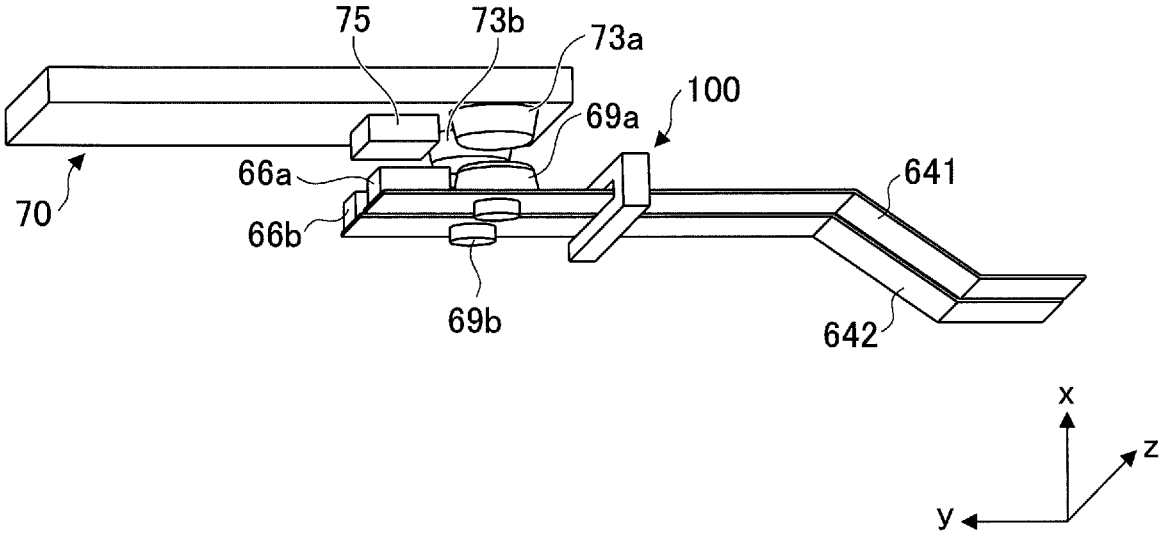
FIG. 19 is a perspective view of contacts according to a tenth embodiment.

A tenth embodiment is described with reference to FIG. 19. FIG. 19 is a perspective view of contacts according to the tenth embodiment.

As illustrated in FIG. 19, the electromagnetic relay 1 includes a pair of movable springs 641 and 642 that extend parallel to each other, and movable irons 66 are provided on the corresponding movable springs 641 and 642. Movable contacts 69 are provided on the movable springs 641 and 642 at positions closer to the rear ends of the movable springs 641 and 642 than the movable irons 66. Fixed contacts 73 are provided on the fixed terminal 70 such that the fixed contacts 73 and the corresponding movable contacts 69 can contact each other.

With the tenth embodiment, similarly to the sixth embodiment, magnetic attraction is generated between the fixed iron 75 and the movable irons 66. Accordingly, the tenth embodiment can also prevent contacts from being opened due to electromagnetic repulsion generated between the contacts. Because two movable contacts 69*a* and 69*b* are separately provided on the separate movable springs 641 and 642 and can move independently, the tenth embodiment enables the movable contacts 69 to more reliably contact the fixed contacts 73.

In FIG. 19, the movable springs 641 and 642 are completely separated from each other. However, the movable springs 641 and 642 may be configured to branch off from a common base part.

An electromagnetic relay according to embodiments of the present invention is described above. However, the present invention is not limited to the specifically disclosed embodiments, and variations and modifications may be made without departing from the scope of the present invention. Components and the arrangements, conditions, and shapes of the components described in the above embodiments are examples and may be changed as necessary. Also, combinations of the components described in the above embodiments may be changed in any appropriate manner.

In the first through fifth embodiments, the electromagnetic relay 1 includes one movable iron 66. However, the electromagnetic relay 1 may include multiple movable irons 66. The movable irons 66 may be arranged in any one of the x-direction, the y-direction, and the z-direction. The movable irons 66 may be arranged at intervals or may be arranged in contact with each other. In this case, the movable irons 66 may be disposed such that the z-axis ends of the movable irons 66 at least partially overlap both of the fixed irons 75*a* and 75*b*. Similarly, at least one of the fixed irons 75*a* and 75*b* may be composed of multiple irons. In the sixth through tenth embodiments, the electromagnetic relay 1 includes one fixed iron 75 and a pair of movable irons 66*a* and 66*b*. However, at least one of the fixed iron 75, the movable iron 66*a*, and the movable iron 66*b* may be composed of multiple irons.

What is claimed is:

1. An electromagnetic relay, comprising:

a movable terminal including a movable contact;

a fixed terminal including a fixed contact that faces the movable contact;

two separate first irons disposed apart from each other on one of the fixed terminal and the movable terminal; and a second iron disposed on another one of the fixed terminal and the movable terminal such that the second iron faces the first irons in a first direction, wherein in plan view seen from the first direction, the second iron partially overlaps both of the first irons.

2. The electromagnetic relay as claimed in claim 1, wherein the first irons and the second iron are disposed on corresponding surfaces of the fixed terminal and the movable terminal that face each other.

3. The electromagnetic relay as claimed in claim 1, wherein the first irons are disposed on side surfaces of the one of the fixed terminal and the movable terminal.

4. The electromagnetic relay as claimed in claim 1, wherein one of the first irons and the second iron is a fixed iron provided on the fixed terminal;

another one of the first irons and the second iron is a movable iron provided on the movable terminal;

the movable terminal and the fixed terminal are disposed such that front ends of the movable terminal and the fixed terminal face opposite directions;

the fixed iron is disposed in a position on the fixed terminal that is closer to a rear end of the fixed terminal than the fixed contact; and the movable iron is disposed in a position on the movable terminal that is closer to the front end of the movable terminal than the movable contact.

5. The electromagnetic relay as claimed in claim 4, wherein the movable iron includes a plate disposed on a front end of the movable terminal; and the movable iron is fixed to the movable terminal by riveting the movable contact passing through the plate and the movable terminal.

6. The electromagnetic relay as claimed in claim 1, wherein one of the first irons and the second iron is a fixed iron provided on the fixed terminal;

another one of the first irons and the second iron is a movable iron provided on the movable terminal;

the movable terminal and the fixed terminal are disposed such that front ends of the movable terminal and the fixed terminal face opposite directions;

the fixed iron is disposed in a position on the fixed terminal that is closer to the front end of the fixed terminal than the fixed contact; and the movable iron is disposed in a position on the movable terminal that is closer to a rear end of the movable terminal than the movable contact.

7. The electromagnetic relay as claimed in claim 6, wherein the fixed iron includes a plate disposed on a front end of the fixed terminal; and the fixed iron is fixed to the fixed terminal by riveting the fixed contact passing through the plate and the fixed terminal.

8. The electromagnetic relay as claimed in claim 1, wherein the movable terminal includes a movable plate and a movable spring attached to the movable plate, the movable contact being disposed on the movable spring;

the movable spring and the fixed terminal are disposed such that front ends of the movable spring and the fixed terminal face opposite directions; and the movable terminal is disposed such that electric currents flow through the fixed terminal and the movable plate in opposite directions when the fixed terminal and the movable terminal are connected to each other.

9. The electromagnetic relay as claimed in claim 1, wherein the first irons include inner edges that face each other in a second direction orthogonal to the first direction; and in plan view seen from the first direction, the second iron is disposed to overlap the inner edges of the first irons.

* * * * *